US006810928B2

(12) United States Patent
Limbach

(10) Patent No.: US 6,810,928 B2
(45) Date of Patent: Nov. 2, 2004

(54) TUBE FILLING MACHINE

(75) Inventor: Rolf Limbach, Eggenstein-Leopoldshafen (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 10/343,110

(22) PCT Filed: Jan. 23, 2002

(86) PCT No.: PCT/EP02/00624

§ 371 (c)(1),
(2), (4) Date: Jan. 28, 2003

(87) PCT Pub. No.: WO02/060755

PCT Pub. Date: Aug. 8, 2002

(65) Prior Publication Data

US 2003/0111133 A1 Jun. 19, 2003

(30) Foreign Application Priority Data

Jan. 29, 2001 (DE) ..... 101 04 069

(51) Int. Cl.[7] ..... B65B 1/04

(52) U.S. Cl. ..... 141/181; 141/144; 141/270; 141/304

(58) Field of Search ..... 141/144, 145, 141/146, 181, 182, 263, 270, 304

(56) References Cited

U.S. PATENT DOCUMENTS 6,070,622 A * 6/2000 Rutter ..... 141/90

FOREIGN PATENT DOCUMENTS

| | | |
|---|---|---|
| DE | 197 18 207 | 11/1998 |
| DE | 198 08 649 | 9/1999 |
| DE | 299 07 459 | 9/1999 |
| DE | 298 08 373 | 10/1999 |
| EP | 0 449 215 | 10/1991 |
| EP | 0 776 829 | 6/1997 |

* cited by examiner

*Primary Examiner*—Gregory L. Huson
*Assistant Examiner*—Peter deVore
(74) *Attorney, Agent, or Firm*—Paul Vincent

(57) ABSTRACT

A tube filling machine comprises a circulating conveying device for transporting a tube through the tube filling machine to pass through different processing stations. One of the processing stations is a filling unit in which the tube can be filled with a desired product. To remove and install the filling unit in a simple and rapid fashion, it is disposed on an adjustable support structure which can be actuated between an operating position in which the filling unit is disposed in the tube filling machine above the tube to be filled and a non-operating position in which the filling unit sidewardly projects out past the tube filling machine.

9 Claims, 2 Drawing Sheets

TUBE FILLING MACHINE

BACKGROUND OF THE INVENTION

The invention concerns a tube filling machine comprising a circulating conveying device for transporting a tube through the tube filling machine to pass through differing processing stations. One of the processing stations is a filling unit in which the tube can be filled with a desired product.

Known tube filling machines have a conveying device which is usually designed as an endless belt or endless chain and which has a plurality of receptacles or tube holders for one tube each. The empty tubes are introduced into the tube holders of the conveying device at a feed station and pass several work stations including, in particular, a filling unit and a subsequent closing unit. In the filling unit, the tubes are filled via a filling pipe which is connected to a filling medium supply via a metering means, and are filled with the desired product or medium. The filled tube is then further transported to the closing unit in which the upper tube end is closed.

If, following filling of a first product or medium in a tube filling machine, another product or medium is to be filled, the filling unit must, for hygienic reasons, be completely cleaned of the remains of the first product. This is usually effected by removing the filling unit from the tube filling machine and cleaning it at an external location. To remove the filling unit, the mounting screws which hold the filling unit in the tube filling machine must first be unscrewed. Subsequently, the filling and metering element drives, i.e. usually the rotary valve drive and the shut-off tappet drive, must be released from the respective filling and metering elements, i.e. the rotary valve and the shut-off tappet. The filling unit, including all the wet parts soiled by the first product, must then be lifted from the tube filling machine using a hoist, e.g. a crane. Since a tube filling machine must be compact in construction, the space for removal and, in particular, lifting of the filling unit is very limited which makes the removal of the filling unit difficult, time-consuming, and therefore expensive. Moreover, the tube filling machine cannot be operated during removal and during installation of a new filling unit.

SUMMARY OF THE INVENTION

It is the underlying purpose of the present invention to produce a tube filling machine of the mentioned type which facilitates removal and installation of the filling unit in a reduced amount of time.

This object is achieved in accordance with the invention in a tube filling machine of the mentioned type in that the filling unit is disposed on a support structure which can be adjusted between an operating position in which the filling unit is located in the tube filling machine above the tube to be filled, and a non-operating position in which the filling unit sidewardly projects out from the tube filling machine.

The invention is based on the fundamental idea of not directly installing the filling unit in the tube filling machine, rather disposal thereof on a special support structure which can be adjusted when necessary. During operation of the tube filling machine, the filling unit is conventionally located above the tubes to be filled, with the support structure being located in the so-called operating position. When the product is to be changed, the support structure is adjusted. It can thereby be sidewardly withdrawn from the tube filling machine, but preferably, the support structure is pivotable such that it can be laterally pivoted out of the tube filling machine. When projecting from the side of the tube filling machine, the support structure is in the so-called non-operating position to provide good access to the filling unit which also projects past the side of the tube filling machine. In this manner, the filling unit disposed on the support structure can be grasped and lifted from the support structure using a conventional hoist, in particular, a crane or fork-lift. Towards this end, a further development of the invention provides a special receptacle for the hoist, which can, in particular, be pipe or rail-like guides for the forks of a fork-lift.

It has been demonstrated that the lateral extension or pivoting of the filling unit considerably decreases its installation and removal times. Consequently, the down times of the tube filling machine during product change are considerably reduced.

Installation or removal of the filling unit can be further accelerated if the drives of the filling and metering elements are automatically decoupled from or coupled to the filling and metering elements during adjustment of the support structure. Towards this end, in a preferred embodiment of the invention, the filling unit comprises a rotary valve and a rotary valve drive which can be automatically decoupled from the rotary valve when adjusting the support structure, and therefore the filling unit, into the non-operating position, and which automatically engages with the rotary valve when adjusting the support structure, and therefore the filling unit, into the operating position. Correspondingly, the filling unit can also comprise at least one shut-off tappet and a tappet drive which can be automatically decoupled from the shut-off tappet when adjusting the support structure, and therefore the filling unit, into the non-operating position, and which automatically engages the shut-off tappet when adjusting the support structure, and therefore the filling unit, into the operating position. The time-consuming release of the connection between the rotary valve and the rotary valve drive or between the shut-off tappet and the tappet drive can therefore be omitted. A further advantage is the fact that the drives can be used for the corresponding filling and metering elements of different filling units, such that each filling unit does not require its own drive means.

In a preferred embodiment of the invention, the support structure comprises a bottom frame and a support arm which is pivotably disposed thereon. An adjustment device is provided between the bottom frame and the support arm. The adjustment means can e.g. be a spindle drive or a piston cylinder unit.

BRIEF DESCRIPTION OF THE DRAWING

Further details and features of the invention can be extracted from the following description of an embodiment with reference to the accompanying drawing.

FIGS. 1 and 2 show only those constructive elements of a tube filling machine 10 which are essential for illustrating the invention. The tube filling machine 10 comprises an endless circulating supply device 11 in the form of a conveyor belt which has a plurality of externally projecting tube holders 12, each containing one tube 13. This embodiment shows a tube filling machine which works in two adjacent rows. The invention can also be used with tube filling machines having one or more rows.

DESCRIPTION OF THE PREFERRED EMBODIMENT

Figure 1:
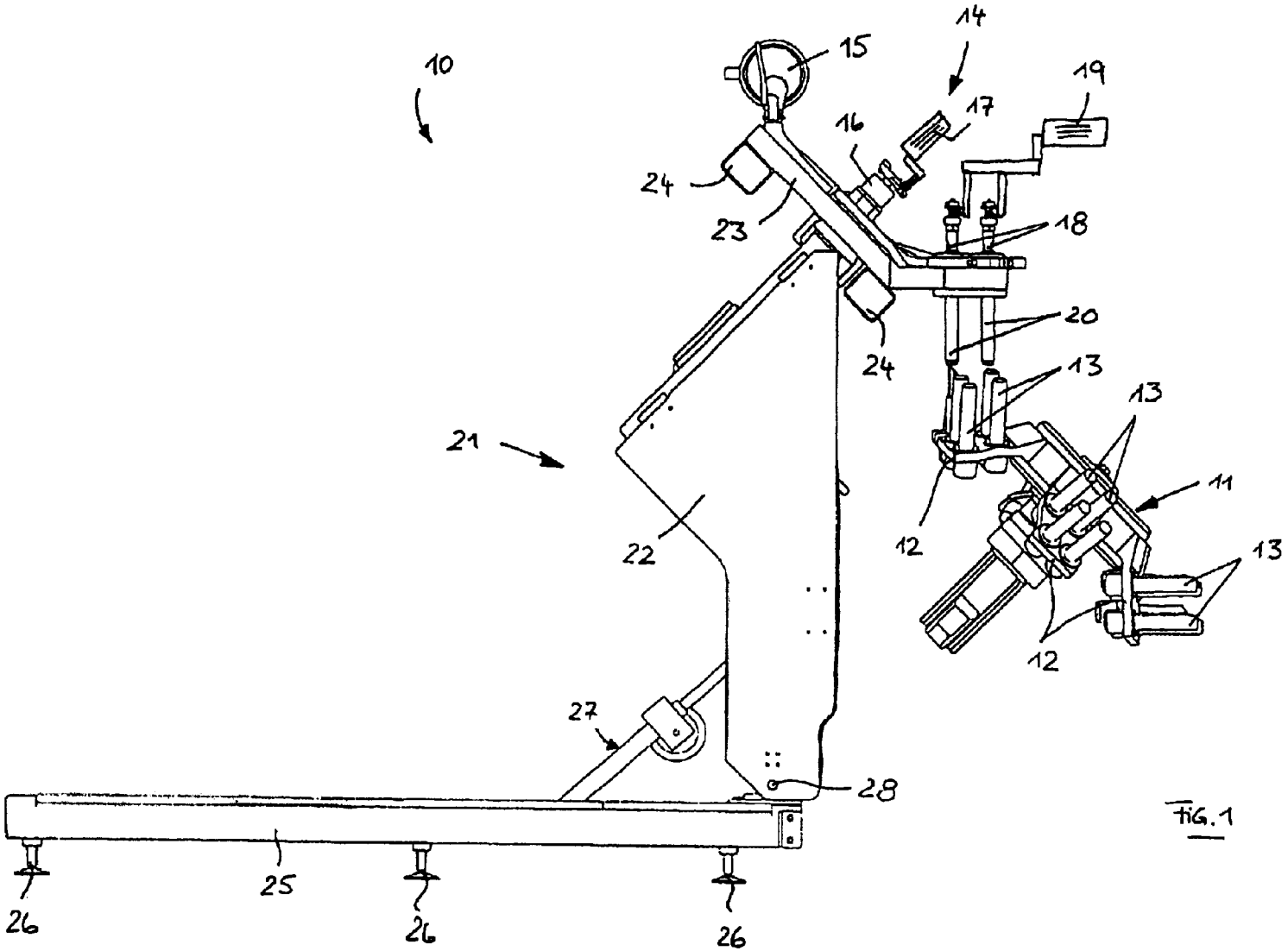
FIG. 1 shows a schematic side view of the essential elements of a tube filling machine in the operating position.

In a region of the supply device 11 in which the tubes 13 are substantially vertical, a filling unit 14 is disposed on top thereof. The filling unit 14 is conventionally constructed having a feed line 14 for the product to be filled, which terminates in vertical filling nozzles 20 which can be inserted from an upward location into the tubes 13 to be filled. The feed line also has a conventional rotary valve 16 and a rotary valve drive 17. Each filling nozzle 20 has an associated tappet 18 with the tappets 18 being driven via a common tappet drive 19.

The rotary valve drive 17 and the tappet drive 19 are fixed in a conventional manner (not shown) in the tube filling machine. The further parts of the filling unit 14, i.e. the feed line 15, the rotary valve 16, the shut-off tappets 18 and the filling nozzles 20 are disposed on a support frame 23 the lower side of which has pipe-like receptacles 24 for a hoist. The support frame 23 is detachably disposed on a support structure 21 which comprises a bottom frame 25 supported on a base by feet 26. A support arm 22 is pivotably disposed about a joint 28 on the bottom frame 25 onto which the supporting frame 23, including the conventional structural parts of the filling unit 14, is disposed. An adjustment device 27 in the form of a spindle drive is disposed between the bottom frame 25 and the support arm 22 to pivot the support arm 22 relative to the bottom frame 25.

In the operating position shown in FIG. 1, the filling unit 14 is conventionally located within the tube filling machine, with the filing nozzles 20 being located above the tubes 13 to be filled and being supplied with the medium to be filled via the feed line 15. The rotary valve 16 is coupled to the rotary slide drive 17 and the shut-off tappets 18 are connected to the tappet drive 19. The supporting frame 22 is in an upright position.

To change the product, the tube filling machine is stopped and the support arm 22 is pivoted out of the tube filling machine into the non-operating position (shown in FIG. 2) by actuating the adjustment device 27. In this position, the support arm 22 including its borne support frame 23 which, in turn, bears the wet parts of the filling unit 14, project laterally from the tube filling machine. The rotary valve drive 17 and the tappet drive 19 thereby remain in the tube filling machine and are automatically decoupled from the rotary valve 16 and the shut-off tappets 18 when the support arm 22 is pivoted.

Figure 2:
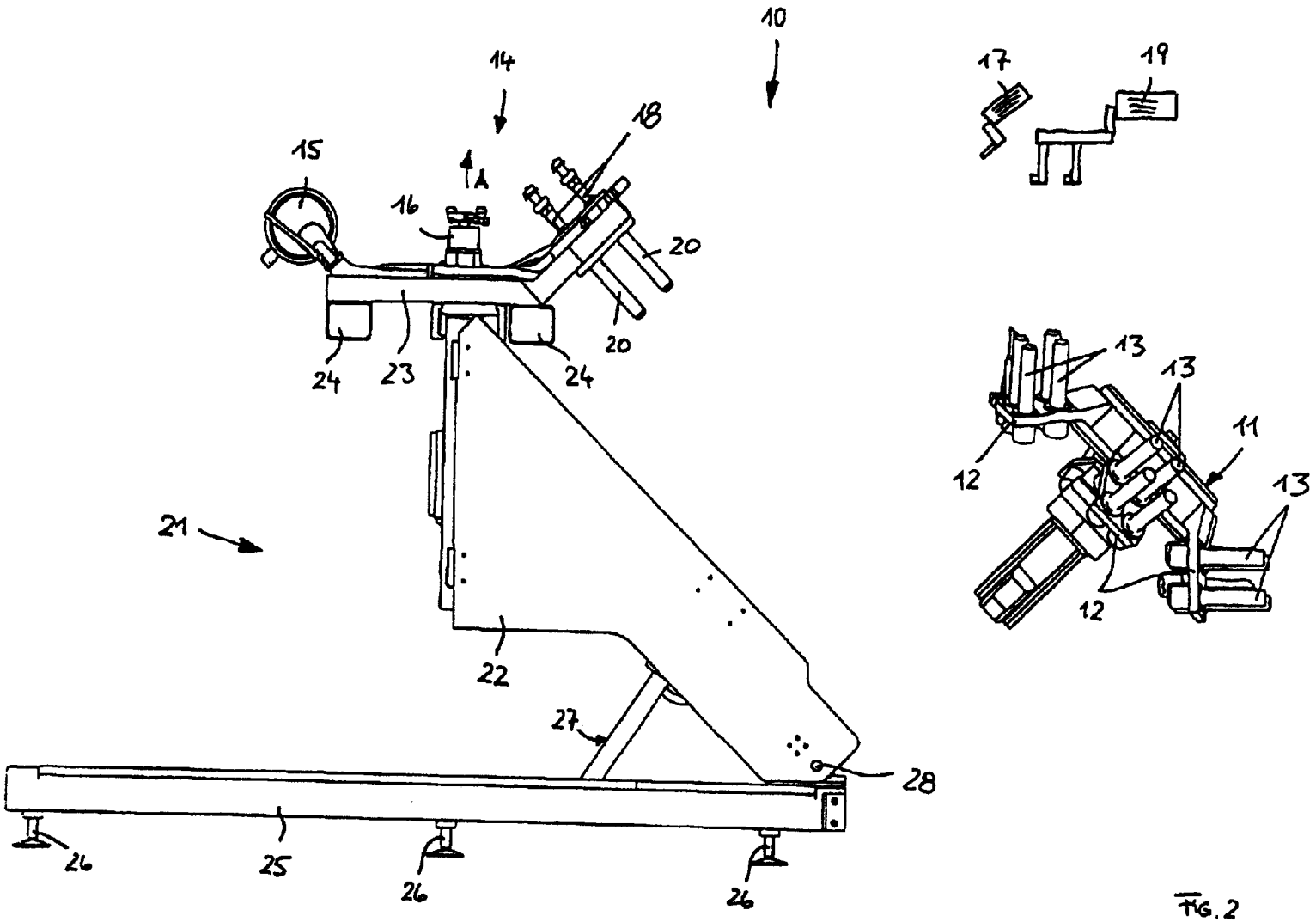
FIG. 2 shows the elements of FIG. 1 in the non-operating position.

In the non-operating position, the two receptacles 24 of the support frame 23 are aligned substantially horizontally next to one another such that the forks of a fork-lift can be introduced into the recepticles 24 to lift the support frame 23 with the feed line 15, rotary valve 16, the shut-off tappets 18 and the filling nozzles 20 from the support arm 22 (indicated by arrow A in FIG. 2). The fork-lift can then dispose a further support frame with cleaned filling and metering elements onto the support arm 22, whereupon same pivots into the tube filling machine into the operating position shown in FIG. 1 through actuating the adjustment device 27 thereby automatically engaging the rotary valve 16 with the fixed rotary valve drive 17, and the shut-off tappet 18 with the fixed tappet drive 19. This position terminates exchange of the filling unit 14.

I claim:

1. A tube filling machine for transporting a tube through differing processing stations and for filling the tube with a desired product, the tube filling machine comprising:

a circulating conveying device for transporting the tube through the differing processing stations;

a filling unit for filling the tube;

a support structure on which said filling unit is disposed; and means for adjusting said support structure between an operating position in which said filling unit is located in the tube filling machine above the tube to be filled, and a non-operating position in which said filling unit projects sidewardly out of the tube filling machine, wherein said filling unit has receptacles for a hoist to lift said filling unit from support structure in said non-operating position.

2. The tube filling machine of claim 1, wherein said support structure is pivotably disposed.

3. The tube filling machine of claim 1, wherein said filling unit comprises a rotary valve with an associated rotary valve drive, wherein said rotary valve drive can be automatically decoupled from said rotary valve when said support structure is adjusted into said non-operating position.

4. The tube filling machine of claim 1, wherein said filling unit comprises at least one shut-off tappet with an associated tappet drive, wherein said tappet drive can be automatically decoupled from said shut-off tappet when said support structure is adjusted into said non-operating position.

5. The tube filling machine of claim 3, wherein said rotary valve drive is fixed within the tube filling machine.

6. The tube filling machine of claim 4, wherein said tappet drive is fixed within the tube filling machine.

7. The tube filling machine of claim 1, wherein said support structure comprises a bottom frame and a support arm pivotably disposed thereon, wherein an adjustment device is disposed between said bottom frame and said Support arm.

8. The tube filling machine of claim 7, wherein said adjustment device is a spindle drive.

9. The tube filling machine of claim 7, said adjustment device is a piston cylinder unit.

* * * * *